US007166002B2

(12) United States Patent
Fukuda et al.

(10) Patent No.: US 7,166,002 B2
(45) Date of Patent: Jan. 23, 2007

(54) CONNECTION TERMINAL

(75) Inventors: Eiji Fukuda, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/150,261

(22) Filed: Jun. 13, 2005

(65) Prior Publication Data

US 2005/0287877 A1 Dec. 29, 2005

(30) Foreign Application Priority Data

Jun. 14, 2004 (JP) ..... 2004-175275

(51) Int. Cl.
*H01R 11/22* (2006.01)

(52) U.S. Cl. ..... 439/849

(58) Field of Classification Search ..... 439/849, 439/852, 850, 862

See application file for complete search history.

(56) References Cited

U.S. PATENT DOCUMENTS 4,696,530 A * 9/1987 Vandame ..... 439/266
5,630,738 A * 5/1997 Ito et al. ..... 439/852
6,152,788 A * 11/2000 Hata et al. ..... 439/852
6,293,833 B1 * 9/2001 Kamath ..... 439/851

FOREIGN PATENT DOCUMENTS

JP 59-3877 1/1984

* cited by examiner

*Primary Examiner*—Tulsidas C. Patel
*Assistant Examiner*—PhuongChi Nguyen
(74) *Attorney, Agent, or Firm*—Finnegan, Henderson, Farabow, Garrett & Dunner, L.L.P.

(57) ABSTRACT

A connection terminal comprises a terminal connection unit and a blade spring. A male terminal is inserted in the terminal connection unit. The blade spring is disposed in the terminal connection unit and press-contacts with the male terminal by means of reacting force generated by flexure deformation thereof. Spring strength of a front area of the blade spring is weaker than that of a rear area of the blade spring, wherein the front area is located at one side of the blade spring from which the male terminal is inserted in the terminal connection unit.

5 Claims, 9 Drawing Sheets

CONNECTION TERMINAL

CROSS REFERENCE TO RELATED APPLICATION

This application claims benefit of priority under 35 U.S.C. §119 to Japanese Patent Application No. 2004-175275, filed on Jun. 14, 2004, the entire contents of which are incorporated by reference herein.

BACKGROUND OF THE INVENTION

1. Field of the Invention

The present invention relates to a connection terminal, more specifically to a connection terminal press-contacting with a male terminal by flexure deformation of a blade spring.

2. Description of the Related Art

A conventional connection terminal is disclosed in Japanese Unexamined Patent Publication No. S59-3877. As shown in FIGS. 1 and 2, a connection terminal 100 comprises a wire connection unit 101 and a terminal connection unit 102. The wire connection unit 101 is connected to the terminal connection unit 102.

The wire connection unit 101 has a base portion 103 and a pair of tightening flaps 104, 104. The tightening flaps 104, 104 are installed to the base portion 103 in a standing manner. A distal end of a wire (not shown) is disposed in room formed by the base portion 103 and the tightening flaps 104, 104. The wire is connected to the wire connection unit 101 by tightening the distal end of the wire with the tightening flaps 104, 104.

The terminal connection unit 102 has a base portion 105, a pair of side wall portions 106, 106, a pair of upper wall portions 107, 107 and a blade spring 108. The side wall portions 106, 106 are installed to the base portion 105 in a standing manner. A pair of supporting plates 106*a*, 106*a* are mounted to a front end and a rear end of the side wall portion 106, respectively. The upper wall portions 107, 107 extend from upper ends of the side wall portion 106, 106 toward a center portion of the terminal connection unit 102. The blade spring 108 is disposed in room formed by the side wall portions 106, 106 and the upper wall portions 107, 107 and supported by the supporting plates 106*a*, 106*a*, 106*a*, 106*a*. The blade spring 108 has a front portion 108*a*, a center portion 108*b* and a rear portion 108*c* and projects downward at the center portion 108*b* when being installed to the terminal connection unit 102.

In the above configuration, when a male terminal 110 is inserted in the terminal connection unit 102 along an insertion direction F, a distal end of the male terminal 110 butts the front portion 108*a* located at an insertion side of the blade spring 108. If the male terminal 110 is further inserted in the terminal connection unit 102, the blade spring 108 receiving a contact load from the male terminal 110 at the front portion 108*a* is flexibly deformed. The deformed blade spring 108 allows the male terminal 110 to be furthermore inserted over the front portion 108*a*. When the male terminal 110 is gradually inserted in the terminal connection unit 102 against reaction force generated by the flexure deformation of the blade spring 108, the male terminal 110 slides on the front portion 108*a* and then on the center portion 108*b* and the base portion 105 to reach to the rear portion 108*c*. The terminal connection unit 102 press-contacts with the male terminal 110, which is inserted to a given position, by means of the reacting force.

In the blade spring 108, spring strength of the front portion 108*a* is set to be approximately equal to that of the rear portion 108*c*. Therefore, in an insertional process of the male terminal 110, the blade spring 108 is flexibly deformed as a whole by pressing the male terminal 110 against the front portion 108*a*. If, as shown in FIG. 3A, we assume that letters A and B are respectively assigned to contact loads received by the blade spring 108 at the front portion 108*a* and the rear portion 108*c*, the male terminal 110 receives reacting force C, which is approximately equal to A+B, of the blade spring 108 from the beginning of inserting the male terminal 110 in the terminal connection unit 102 as shown in FIG. 3B.

Therefore, the male terminal 110 must be strongly pressed against the front portion 108*a* in order to be inserted inside the terminal connection unit 102. This leads to a poor insertional operation of the male terminal 110.

SUMMARY OF THE INVENTION

The object of the present invention is to provide a connection terminal capable of improving an insertional operation of a male terminal.

In order to achieve the above object, the present invention provides a connection terminal comprising: a terminal connection unit in which a male terminal is inserted: and a blade spring disposed in the terminal connection unit and press-contacting with the male terminal by means of reacting force generated by flexure deformation thereof, wherein spring strength of a front area of the blade spring is weaker than that of a rear area of the blade spring, the front area being located at one side of the blade spring from which the male terminal is inserted in the terminal connection unit.

According to the present invention, a contact load received by the blade spring at the rear area of the blade spring is little generated per unit area at the beginning of an insertional process of the male terminal because the spring strength of the rear area is larger than that of the front area. Therefore, an insertional operation of a male terminal is improved at the beginning of the insertional process.

DESCRIPTION OF THE PREFERRED EMBODIMENT

Hereinafter, with reference to FIGS. 4 to 9C, an embodiment of the present invention is described.

Figure 1:
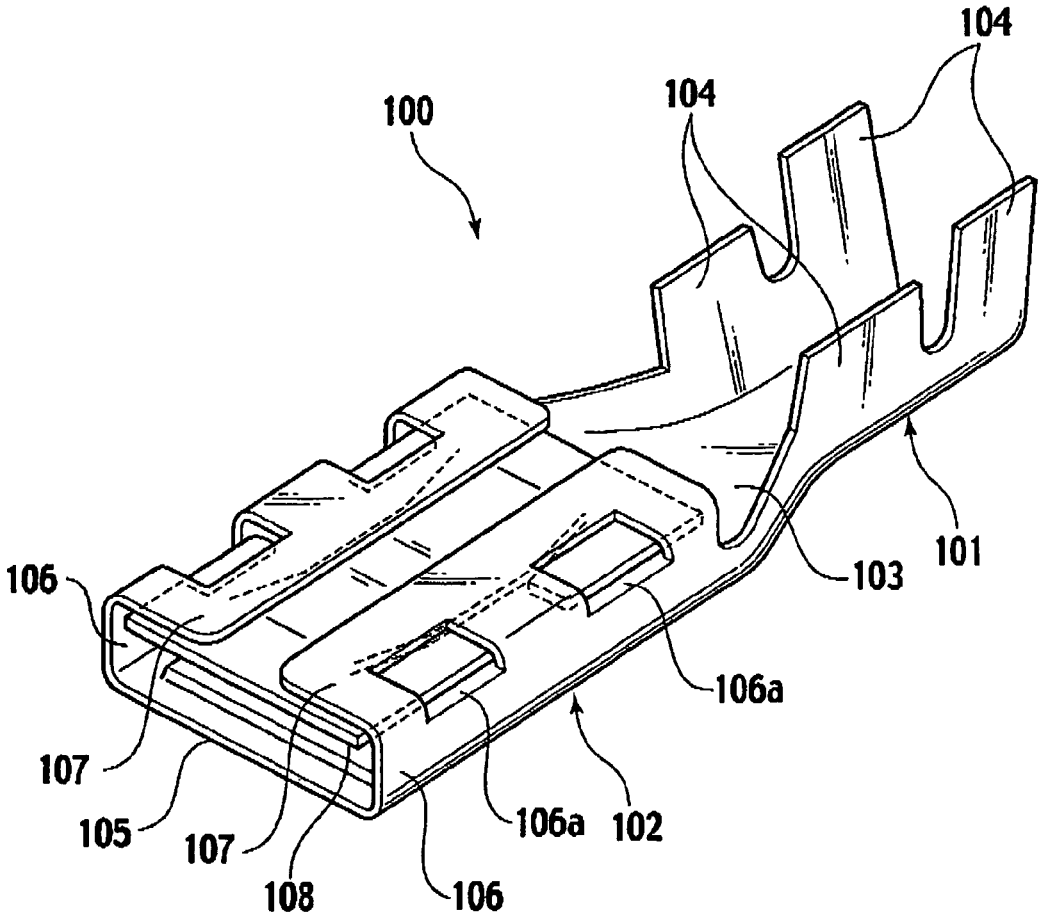
FIG.1 PRIOR ART
FIG. 1 is a perspective view of a conventional connection terminal.
Figure 2:
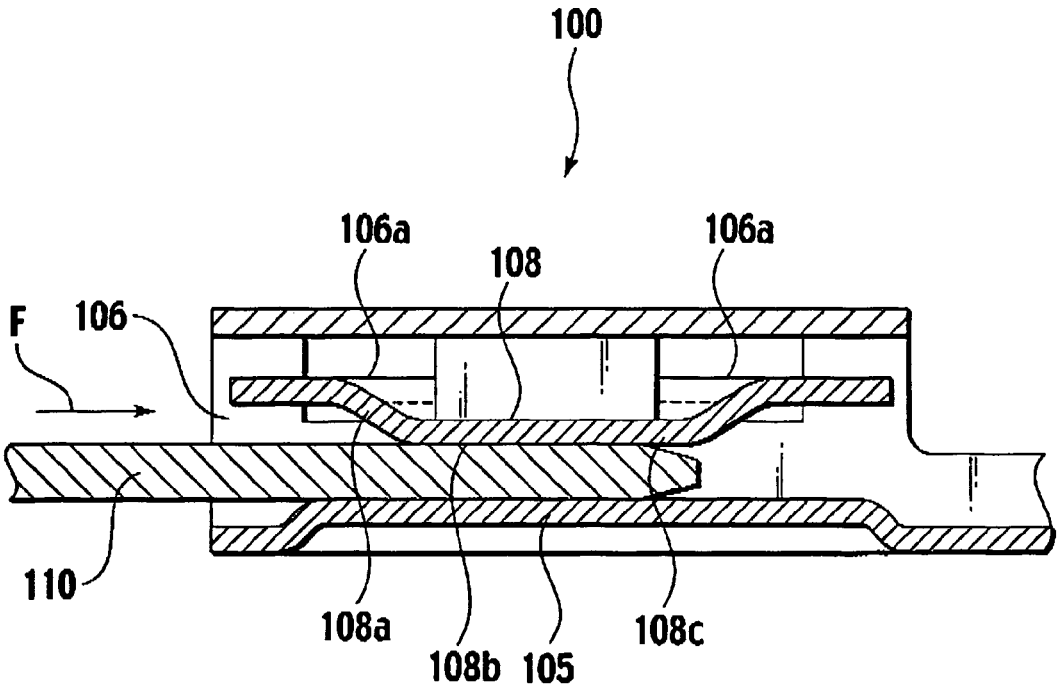
FIG.2 PRIOR ART
FIG. 2 is a cross-section view of the conventional connection terminal.
Figure 3A:
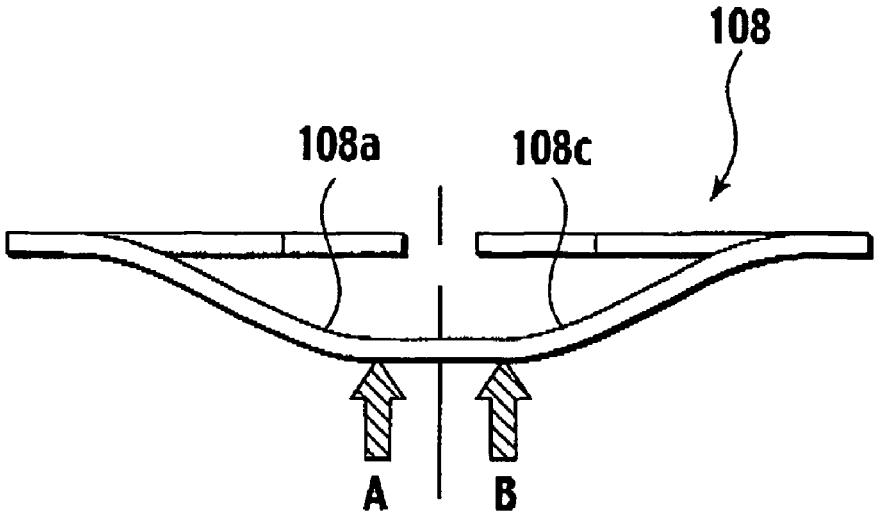
FIG.3A PRIOR ART
FIG. 3A is a view illustrating contact loads received by a blade spring at a front and rear portions of the blade spring.
Figure 3B:
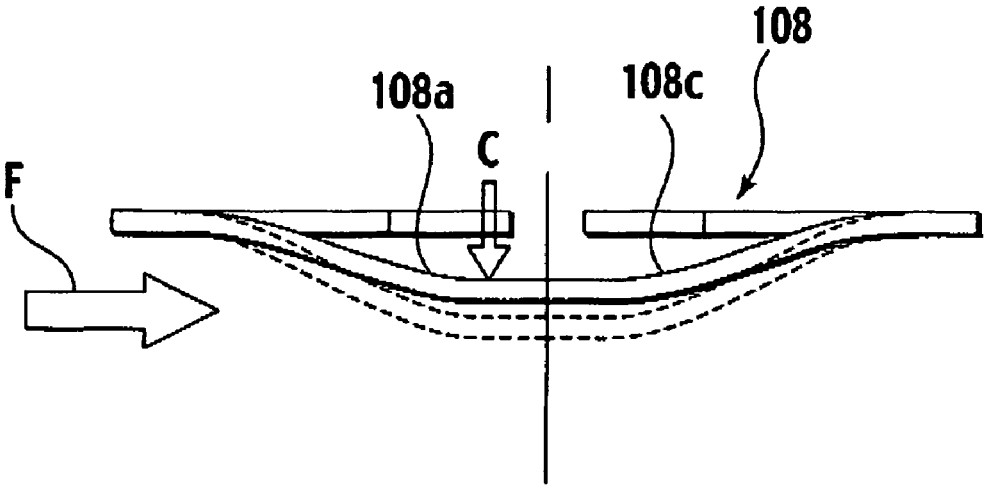
FIG.3B PRIOR ART
FIG. 3B is a view illustrating reacting force of the blade spring.
Figure 4:
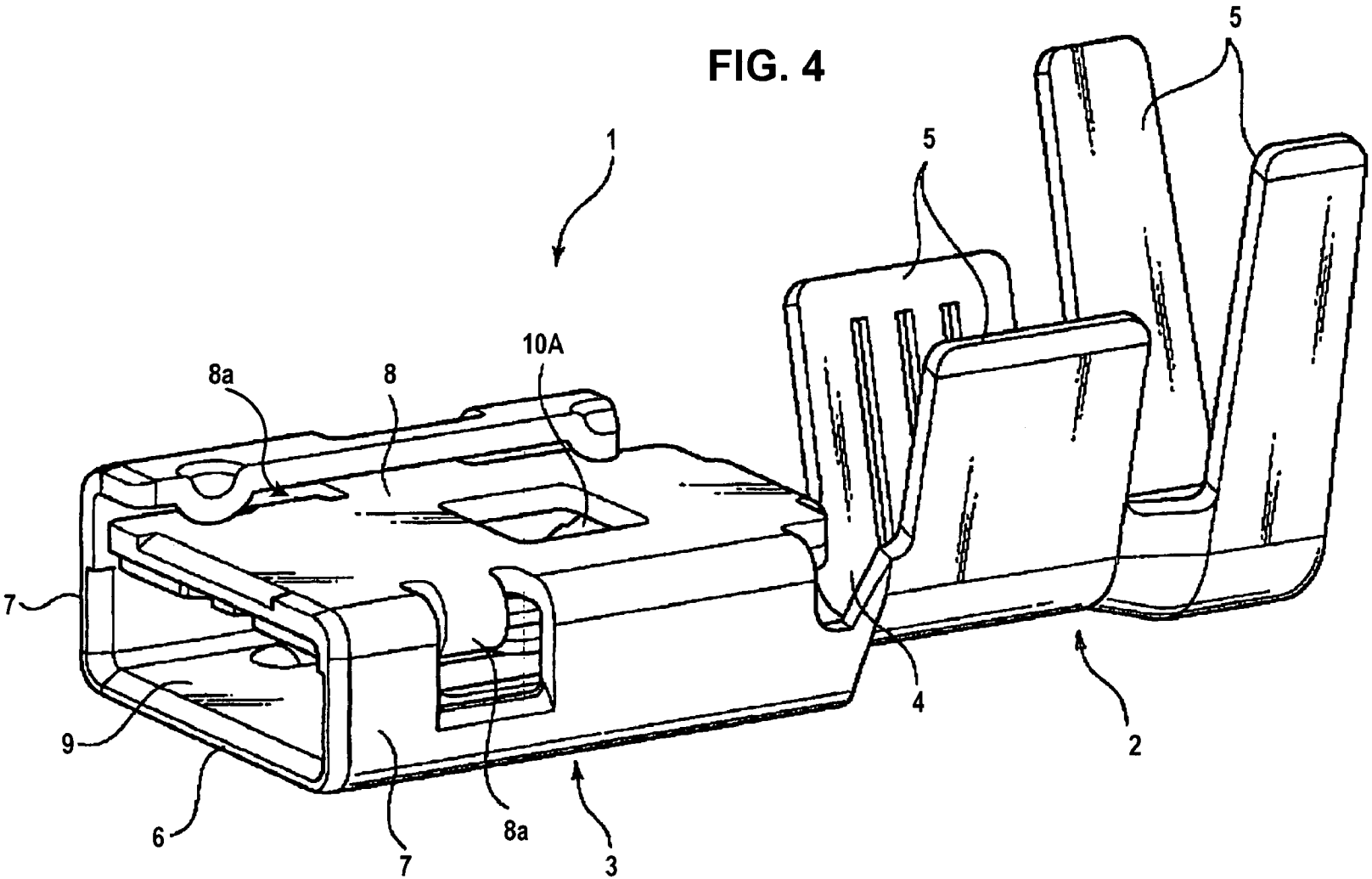
FIG. 4 is a perspective view of a connection terminal according to an embodiment of the present invention.
Figure 5:
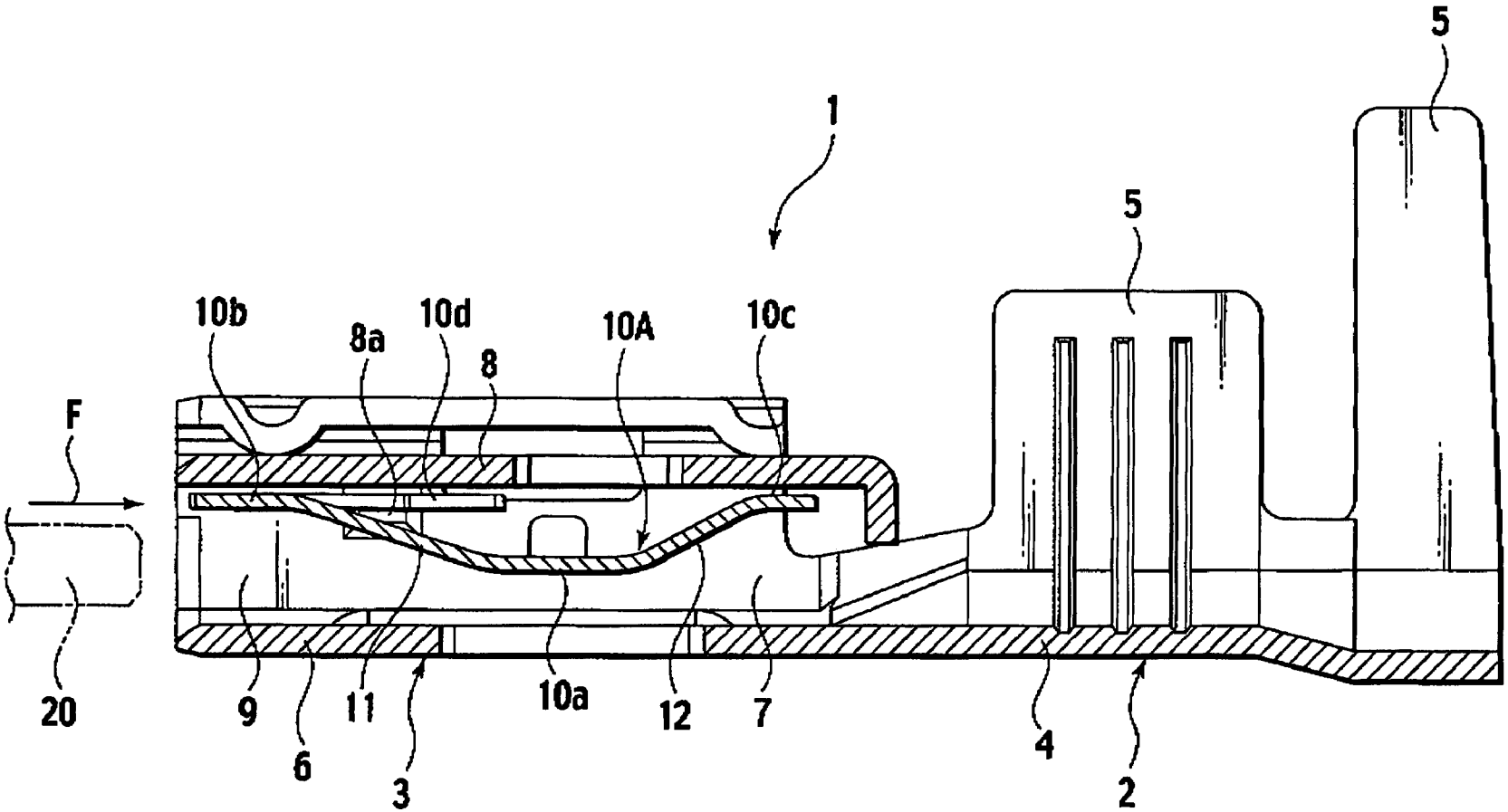
FIG. 5 is a cross-section view of the connection terminal according to the embodiment of the present invention.

As shown in FIGS. 4 and 5, a connection terminal 1 comprises a wire connection unit 2 and a terminal connection unit 3. The wire connection unit 2 is connected to the terminal connection unit 3.

The wire connection unit 2 has a base portion 4 and a pair of tightening flaps 5, 5. The tightening flaps 5, 5 are installed to both ends of the base portion 4 in a standing manner. A distal end of a wire (not shown) is disposed in room formed by the base portion 4 and the tightening flaps 5, 5. The wire is connected to the wire connection unit 2 by tightening the distal end of the wire with the tightening flaps 5, 5.

The terminal connection unit 3 has a base portion 6, a pair of side wall portions 7, 7, an upper wall portion 8 and a blade spring 10A. The side wall portions 7, 7 are installed to both ends of the base portion 6 in a standing manner. The upper wall portion 8 extends from an upper end of one of the side wall portions 7, 7 toward the other of the side wall portions 7, 7. The upper wall portion 8 is disposed in parallel to the base portion 6. A pair of sandwiching plates 8*a*, 8*a* extend from both front ends of the upper wall portion 8 toward a center portion of the terminal connection unit 3. More specifically, the sandwiching plates 8*a*, 8*a* extend into a room 9 formed by the side wall portions 7, 7 and the upper wall portion 8.

The blade spring 10A is disposed in the room 9 and sandwiched between the upper wall portion 8 and the sandwiching plates 8*a*, 8*a*. The blade spring 10A has a center portion (deformable portion) 10*a*, a front portion 10*b* and a rear portion 10*c* and projects downward at the deformable portion 10*a* when being installed to the terminal connection unit 3.

Figure 6A:
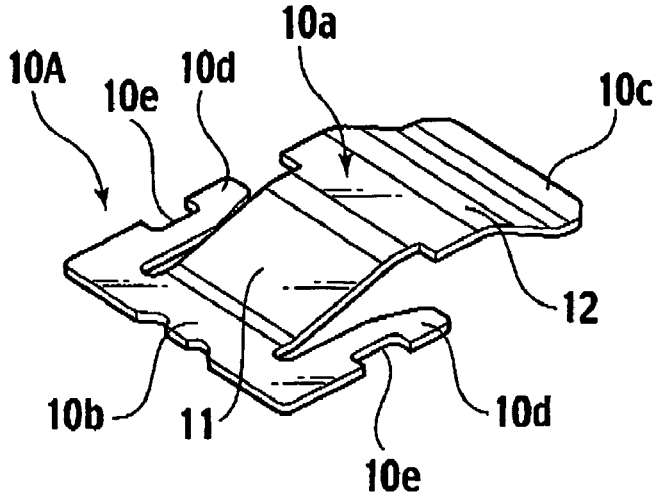
FIG. 6A is a perspective view of a blade spring according to the embodiment of the present invention.
Figure 6B:
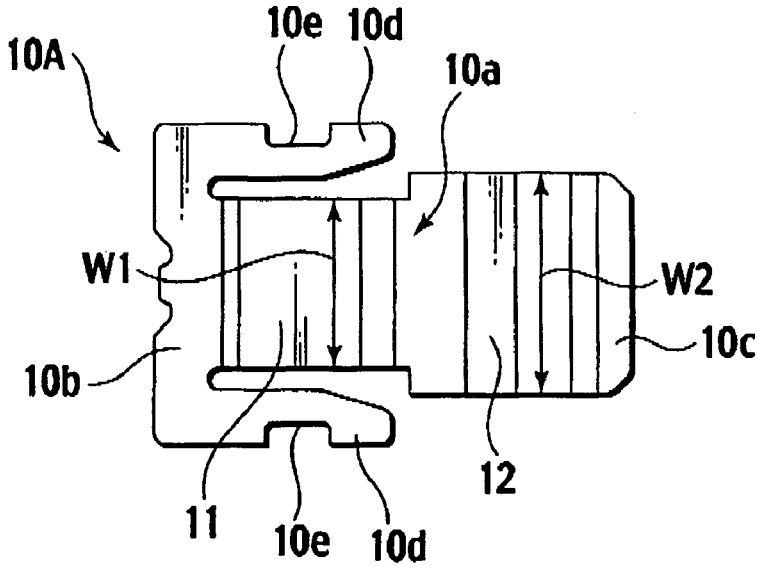
FIG. 6B is a bottom view of the blade spring according to the embodiment of the present invention.
Figure 6C:
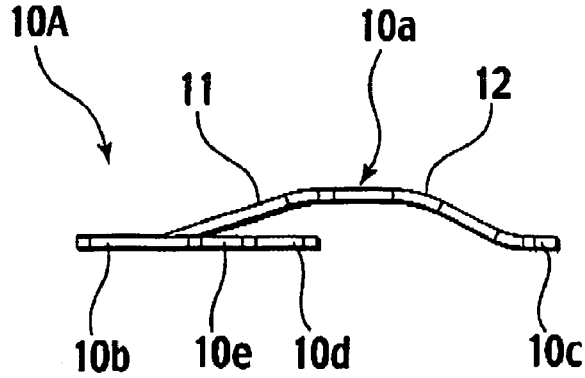
FIG. 6C is a cross-section view of the blade spring according to the embodiment of the present invention.

As shown in FIGS. 6A to 6C, the deformable portion 10*a* has a front area 11 and a rear area 12. When the blade spring 10A is installed to the terminal connection unit 3, the front area 11 is located at one side of the blade spring 10A from which a male terminal 20 is inserted in the terminal connection 6 unit 3. Spring strength of the front area 11 is weaker than that of the rear area 12 because a width W1 of the front area 11 is smaller than a width W2 of the rear area 12.

The front portion 10*b* and the rear portion 10*c* are integrally connected to the front area 11 and the rear area 12 of the deformable portion 10*a*, respectively. A pair of sandwiched portions 10*d*, 10*d* are integrally connected to both ends of the front portion 10*b*. The sandwiched portions 10*d*, 10*d* extend along both side surfaces of the deformable portion 10*a*, respectively. The sandwiched portions 10*d*, 10*d* have grooves 10*e*, 10*e* at center portions thereof, respectively. Each groove 10*e* opens at an outside side surface of the sandwiched portion 10*d*.

If the sandwiching plates 8*a*, 8*a* are guided below the sandwiched portions 10*d*, 10*d* through the grooves 10*e*, 10*e*, the sandwiched portions 10*d*, 10*d* are sandwiched between the upper wall portion 8 and the sandwiching plates 8*a*. 8*a*. In this state, the blade spring 10A is fixedly sandwiched between the upper wall portion 8 and the sandwiching plates 8*a*, 8*a* at the sandwiched portions 10*d*, 10*d*. In contrast, the blade spring 10A can freely move at the rear portion 10*c*.

In the above configuration, when the male terminal 20 is inserted in the terminal connection unit 3 along an insertion direction F, a distal end of the male terminal 20 butts the front area 11 of the deformable portion 10*a* located at an insertion side of the blade spring 10A. If the male terminal 20 is further inserted in the terminal connection unit 3, the deformable portion 10*a* receiving a contact load from the male terminal 20 is flexibly deformed. The deformed blade spring 10A allows the male terminal 20 to be furthermore inserted over the front area 11. When the male terminal 20 is gradually inserted in the terminal connection unit 3 against reacting force generated by the flexure deformation of the blade spring 10A, the male terminal 20 slides on the front area 11 and the base portion 6 to reach to the rear area 12. The terminal connection unit 3 press-contacts with the male terminal 20, which is inserted to a given position, by means of the reacting force.

Figure 7A:
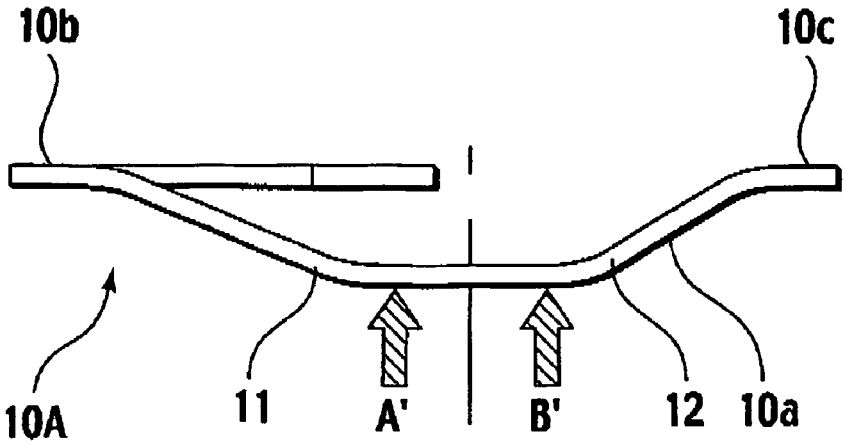
FIG. 7A is view illustrating contact loads received by the blade spring at a front and rear portions of the blade spring according to the embodiment of the present invention.
Figure 7B:
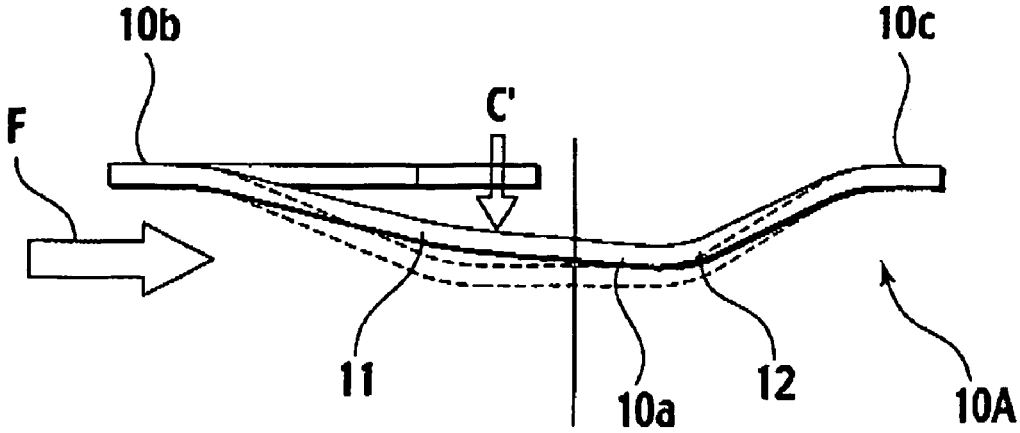
FIG. 7B is a view illustrating reacting force of the blade spring according to the embodiment of the present invention.

In the blade spring 10A, spring strength of the front area 11 is set to be weaker than that of the rear area 12. Therefore, in an insertional process of the male terminal 20, the blade spring 10A is flexibly deformed at the front area 11 by pressing the male terminal 20 against the front area 11. If, as shown in FIG. 7A, we assume that letters A' and B' are respectively assigned to contact loads received by the blade spring 10A at the front area 11 and the rear area 12, the male terminal 20 receives reacting force C', which is approximately equal to A'+B', of the blade spring 10A from the beginning of inserting the male terminal 20 in the terminal connection unit 3 as shown in FIG. 7B.

It is noted that the contact loads A', B' are respectively smaller than the contact loads A, B of the conventional blade spring 108 per unit-area since the blade spring 10A can freely move at the rear area 12. Also, it is noted that the contact load B' is little generated per unit area at the beginning of the insertional process since the spring strength of the rear area 12 is larger than that of the front area 11.

The connection terminal 1 has advantageous features listed below.

An insertional operation of a male terminal is improved at the beginning of the insertional process because the contact load B' is little generated per unit area.

The insertional operation of a male terminal is improved in a total insertional process because the contact loads A', B' are respectively smaller than the contact loads A, B of the conventional blade spring 108 per unit area.

A blade spring having a different between spring strength of a front area and that of a rear area is easily manufactured because the spring strength of the front area and that of the rear area can be varied by only changing widths of the front area and the rear area.

Next a first modified form of the present embodiment is described.

Figure 8A:
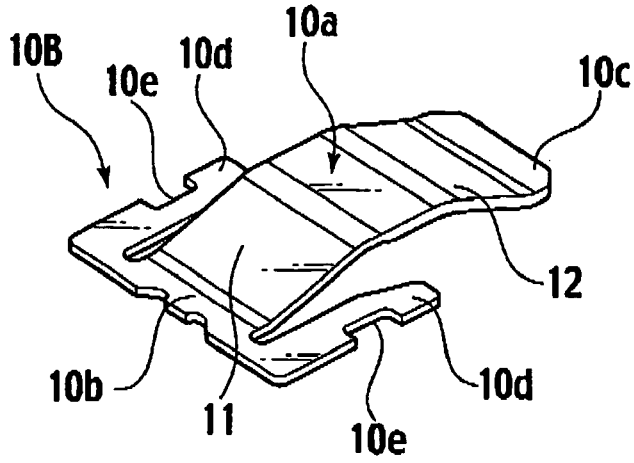
FIG. 8A is a perspective view of a blade spring according to a first modified form of the embodiment of the present invention.
Figure 8B:
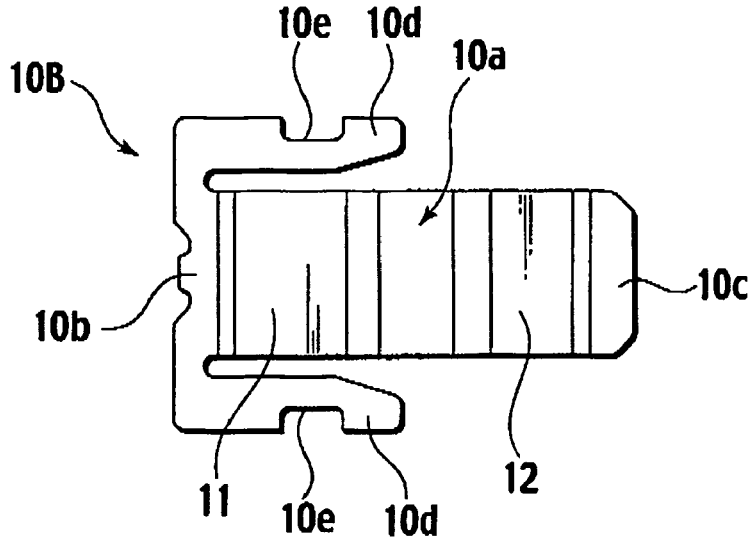
FIG. 8B is a bottom view of the blade spring according to the first modified form of the embodiment of the present invention.
Figure 8C:
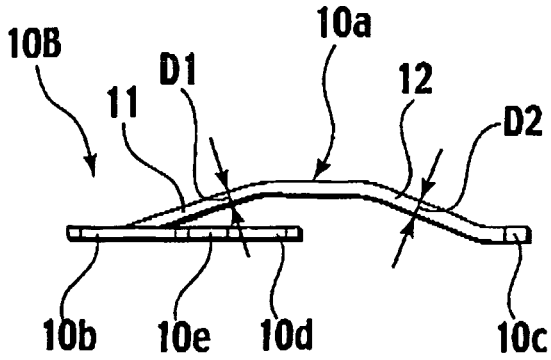
FIG. 8C is a cross-section view of the blade spring according to the first modified form of the embodiment of the present invention.

As shown in FIGS. 8A to 8C, a width of the front area 11 is equal to that of the rear area 12 and a thickness D1 of the front area 11 is smaller than a thickness D2 of the rear area 12. In this state, spring strength of the front area 11 is smaller than that of the rear area 12.

It is noted that the contact load B' is little generated per unit area at the beginning of the insertional process because the spring strength of the rear area 12 is larger than that of the front area 11.

The connection terminal of the first modification form has advantageous features listed below.

An insertional operation of a male terminal is improved at the beginning of the insertional process because the contact load B' is little generated per unit.

A blade spring having a different between spring strength of a front area and that of a rear area is easily manufactured because the spring strength of the front area and that of the rear area can be varied by only changing thicknesses of the front area and the rear area.

Next a second modified form of the present embodiment is described.

Figure 9A:
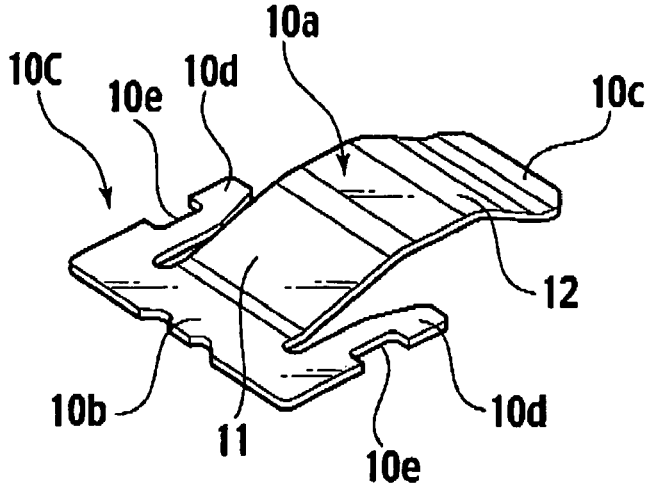
FIG. 9A is a perspective view of a blade spring according to a second modified form of the embodiment of the present invention.
Figure 9B:
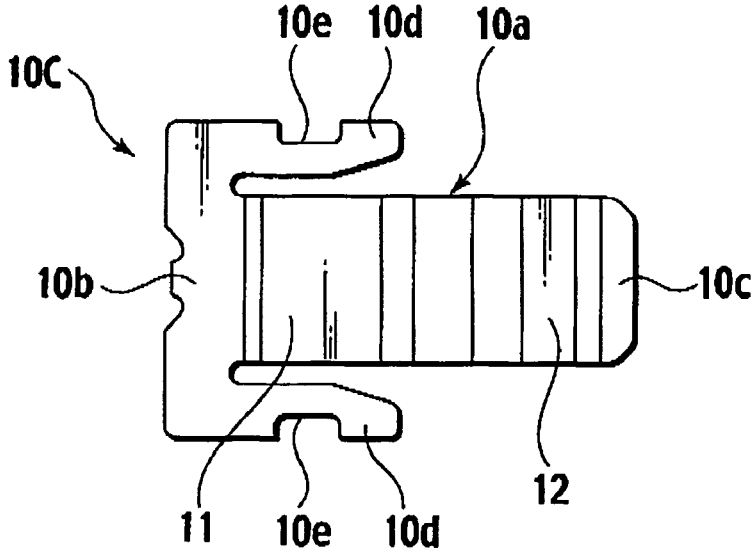
FIG. 9B is a bottom view of the blade spring according to the second modified form of the embodiment of the present invention.
Figure 9C:
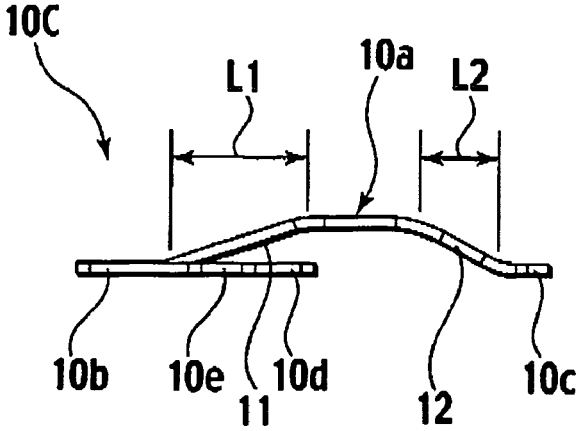
FIG. 9C is a cross-section view of the blade spring according to the second modified form of the embodiment of the present invention.

As shown in FIGS. 9A to 9C, a width and thickness of the front area 11 are equal to those of the rear area 12 and a length L1 of the front area 11 is larger than a length L2 of the rear area 12. In this state, spring strength of the front area 11 is smaller than that of the rear area 12.

It is noted that the contact load B' is little generated per unit area at the beginning of the insertional process because the spring strength of the rear area 12 is larger than that of the front area 11.

The connection terminal of the second modification form has advantageous features listed below.

An Insertional operation of a male terminal is improved at the beginning of the insertional process because the contact load B' is little generated per unit.

A blade spring having a different between spring strength of a front area and that of a rear area is easily manufactured because the spring strength of the front area and that of the rear area can be varied by only changing lengths of the front area and the rear area.

What is claimed is:

1. A connection terminal comprising:

a terminal connection unit in which a male terminal is inserted, the terminal connection unit comprising:

a base portion;

a pair of side wall portions installed to both ends of the base portion in a standing manner;

an upper wall portion extending from an upper end of one of the side wall portions toward the other of the side wall, portions;and a pair of sandwiching plates extending from both front ends of the upper wall portion toward a center portion of the terminal connection unit, the front end being located at one side of the upper wall from which the male terminal is inserted in the terminal connection unit, and a blade spring disposed in the terminal connection unit, sandwiched between the upper wall portion and the sandwiching plates at the front end thereof, and press-contacting with the male terminal by means of reacting force generated by flexure deformation thereof, wherein spring strength of a front area of the blade spring is weaker than that of a rear area of the blade spring, the front area being located at one side of the blade spring from which the male terminal is inserted in the terminal connection unit.

2. The connection terminal according to claim 1, wherein a width of the front area is smaller than that of the rear area.

3. The connection terminal according to claim 1. wherein a thickness of the front area is smaller than that of the rear area.

4. The connection terminal according to claim 1, wherein a length of the front area is larger than that of the rear area.

5. The connection terminal according to claim 1, wherein the blade spring can freely move at the rear area thereof.

* * * * *